US007045934B2

(12) United States Patent
Geskin et al.

(10) Patent No.: US 7,045,934 B2
(45) Date of Patent: May 16, 2006

(54) METHOD FOR JET FORMATION AND THE APPARATUS FOR THE SAME

(76) Inventors: Ernest Geskin, 21 Karen Pl., Edison, NJ (US) 08817-2149; Boris Goldenberg, 1305 E. 18th St. #5D, Brooklyn, NY (US) 11230

( * ) Notice: Subject to any disclaimer, the term of this patent is extended or adjusted under 35 U.S.C. 154(b) by 395 days.

(21) Appl. No.: 10/119,777

(22) Filed: Apr. 11, 2002

(65) Prior Publication Data

US 2003/0192955 A1 Oct. 16, 2003

(51) Int. Cl.
*F04B 43/14* (2006.01)

(52) U.S. Cl. ..... 310/328; 417/474; 417/475; 239/3; 239/4

(58) Field of Classification Search ..... 310/328; 417/474, 475; 239/3, 4, 679
See application file for complete search history.

(56) References Cited

U.S. PATENT DOCUMENTS 3,683,212 A * 8/1972 Zoltan ..... 310/328
4,023,929 A * 5/1977 Becker et al. ..... 436/81
4,260,106 A * 4/1981 Bauer ..... 239/11
4,367,480 A * 1/1983 Kotoh ..... 347/71
4,379,246 A * 4/1983 Guntersdorfer et al. ..... 310/328
4,596,364 A * 6/1986 Bauer ..... 239/589.1
4,790,479 A * 12/1988 Matsumoto et al. ..... 239/102.2
4,830,872 A * 5/1989 Grenfell ..... 427/472
5,463,413 A * 10/1995 Ho et al. ..... 347/65
5,659,346 A * 8/1997 Moynihan et al. ..... 347/68
5,996,903 A * 12/1999 Asai et al. ..... 239/4

FOREIGN PATENT DOCUMENTS

FR 2640698 A1 * 6/1990
GB 2238833 A * 6/1991
JP 2001-310300 * 11/2001

* cited by examiner

*Primary Examiner*—Thomas M. Dougherty
(74) *Attorney, Agent, or Firm*—I. Zborovsky

(57) ABSTRACT

The method of and the apparatus for the formation of a high-speed fluid or slurry jets of a desired geometry are invented. According to the present invention a fluid or slurry jet is formed by the expelling of a compressed fluid via a slot formed by two attached plates separated by the insertion. The shape of the slot is determined by the forms of the plates and the insertion. This shape is also determined by the deformation of the plates and the insertion by the external forces applied to the plates, for example by the fasteners connecting the plates.

27 Claims, 4 Drawing Sheets

METHOD FOR JET FORMATION AND THE APPARATUS FOR THE SAME

FIELD OF THE INVENTION

The present invention relates to the method and device for formation of the high-speed liquid and slurry jets, more particularly to optimal control of the jet geometry.

BACKGROUND OF THE INVENTION

In recent years high-speed fluid and slurry jets have become a conventional tool in manufacturing, infrastructure maintenance and environment protection. A number of new non-traditional jet applications are emerging in mining, medicine and defense. These applications range from demolition of buildings and breakage of stones to eye surgery, from cleaning of the ocean bottom and deicing the roads to precision machining.

Conventionally the jets are formed by expelling a compressed fluid through an opening in a metal or ceramic body termed a nozzle. In most cases the openings are round. This geometry is determined by the conditions of the nozzle fabrication. It is much easier to generate a round opening in a solid body than an opening of any other geometry. The round nozzle minimizes the ratio between the surface and the flow rate of the stream. Thus it minimizes the specific head losses. The stability of the round jets that is its ability to resist decomposition into an array of droplets is maximal.

The round geometry has, however, significant shortcomings. In a number of practical cases a stream having high aspect ratio is more beneficial than the omni directional round stream. In the case of cutting the long side should be parallel to the direction of cutting (knife, saw), while in the case of cleaning the long side should be normal to the direction of the motion (brush). The enlargement of the length (cutting) or width (cleaning) of the jet cross section increases the rate of processing. But in the case of the omni directional round jet the increase of the useful dimension brings about unnecessary or even damaging change of the jet geometry. Increase of the width of a saw beyond the level, which assures its strength, results in the excessive energy consumption and material losses. Similarly, excessive diameter of the cutting jet brings about the needless losses of energy and material. Excessive jet diameter in the course of surface processing, similarly to an excessive width of a brush, increases energy consumption. Another shortcoming of the round jet is uneven rate of energy supply to the substrate by a moving jet. Thus, generation of the homogeneous surface in the course of the processing using the round jet is difficult if not impossible. Still another shortcoming of the round nozzles is impossibility to repair a worn nozzle. Because of this the highly erosive abrasive jets are conventionally formed by the entrainment of the abrasive particles by the jet rather than by the acceleration of the slurry.

The use of the shaped non-round (diamond, ellipse, etc.) openings improves nozzle performance. However due to the intensive wear these nozzles rapidly lose their integrity and thus cannot last sufficiently long. Besides, the formation of a precision shaped orifice in a hard solid material is an expensive operation.

PREVIOUS ART

A number of slot nozzles were suggested so far. U.S. Pat. No. 4,466,574 describes an apparatus for supplying a coherent curtain of liquid comprising a rectangular nozzle being divided into multiplicity of individual passages. U.S. Pat. No. 4,570,859 uses a set of apertures where the number of open apertures can be controlled. U.S. Pat. No. 4,960,245 suggests the use of the slot nozzle for continuous casting of elongated strips, including relatively thin ribbons. The cashable refractory insertion is used to control the width of the ribbon. The U.S. Pat. No. 5,366,161 describes an apparatus where a fluid (foam) is supplied via a round inlet and exits via a slot extending through a round pipe. An adjustable slot nozzle is suggested in the U.S. Pat. No. 5,370,319. The nozzle comprises provision for control of the rate of the fluid supply and the width of the elongated slot. U.S. Pat. No. 5,862,993 devise a slot nozzle comprising two slider elements displaceable relative to one another. The slider elements form the cavity connecting the inlet of the nozzle with a slot which constitutes the nozzle exit. The elements are attached by pressure applied to one of the elements and the contact area is sealed. The suggested nozzle slot is readily disassembled.

The previous art does not address several key issues pertinent to the use of the slot nozzle. First of all, the jet processing (cutting, cleaning, decoating) involves the use of high pressure fluid for the jet formation. The fluid containment prior to the exit from the nozzle requires special arrangement for prevention of fluid leaks from the nozzle body. Then, the known slot nozzles contain provisions for control of the long side of the slot (width). Equally important is control of the length of the short side of the slot (height). The current state of the art does not provide this opportunity.

The rectangular nozzle contains opportunities which neither available at round nozzles nor provided by the current state of the art of the design of the slot nozzles. It is possible in principle to use the slot nozzle for the energy injection in the fluid, for formation of the pulse jets, etc. It is therefore, objective of this invention to address above shortcomings of present state of the art.

SUMMARY OF THE INVENTION

Accordingly, it is a primary object of the present invention to provide a slot nozzle able to accommodate high pressure fluid or slurry.

It is another object the present invention to provide the means for control of the slot geometry.

A further object of this invention is to provide the means for rapid inexpensive change of the worn parts of the nozzle.

It is still further object of the invention is to form uniform mixture of fluids and particles.

It is also object of this invention to utilize the combination of the liquid compression prior to the slot nozzle, rapid decompression I at the entrance of the slot and the negligible thermal and diffusion resistance of the flow in the slot in order to use the slot as a reactor for material production, for example for water decomposition into hydrogen and oxygen.

To achieve the forgoing and other objects and in accordance with purpose of the present invention as described herein, the invention advances the teaching of the prior art by providing an inexpensive well sealed nozzle assembly comprising two attached plates and containing a port for supply of a fluid, for example water, a slot for dispensing the fluid and the channels connecting this port with a slot. The form of the slot can readily vary to generate a high speed jet of a desired geometry. The jet geometry is determined by the form of the slot obtained in the course of inexpensive machining of the plates. In order to prevent the leaks of the fluids from the nozzle the hydraulic resistance of the slot is minimal while the hydraulic resistance of the plates contact is maximal. In order to maximize the resistance the contact surfaces of the plates are well polished and the plates are connected by a set of fasteners, glued or brazed. The deformation of the plates induced by fasteners secures the sealing of the nozzle and controls the slot geometry. A worn nozzle can be readily restored by polishing of the contact surfaces and machining of the slot area.

The sealing of the nozzle can be improved by a multilayer insertion separating the plates. The shape of the insertion determines the length of the slot, a number and thickness of the layers determines the height of the slot, while the deformation of the insertion secures the sealing of the nozzle. The slot can be formed by two insertions into the plates normal to the direction of the flow. The insertions are fabricated out of a wear resistant material and are readily replaceable.

The fluid can be periodically compressed in a reservoir by forces applied to the plates and deforming them. This results in the formation of a pulse jet, which has well known technological advantages. Different fluids and particles can be added into the reservoir or entrained into the jet in special chambers accommodating the jet exiting the slot. The shape of the jet enhances the process of the entrainment.

According to the method of the invention a continuous or pulse high speed jet is formed and can be used for material removal, deposition, mixing or modification.

Also according to this invention a set of conditions which can be developed in the slot (fast decompression, feasibility of the fast cooling or heating, feasibility to induce strong magnetic and electrical field, feasibility to attain close contact with catalic media or introduce an another reactant) enable us to use the slot as a reactor for material production.

Still other objects of the invention will become apparent to those skilled in art from the following description.

BRIEF DESCRIPTION OF THE DRAWINGS

The accompanying drawings incorporated in and forming a part of the specification illustrate several aspects of the present invention and together with the description serve to explain the principles of the invention. In the drawings.

DETAILED DESCRIPTION OF THE INVENTION

Figure 1:
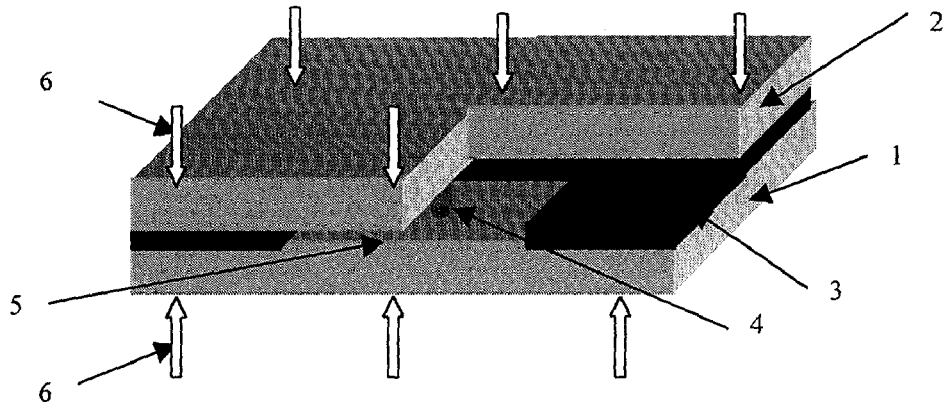
FIG. 1 is a schematic of the slot nozzle depicting the geometries of the plates and the insertion forming the nozzle as well the forces sealing the nozzle.

As it is shown in FIG. 1 the low 1 and the upper 2 plates are separated by the insertion 3. In this nozzle a fluid being accelerated flows from the inlet 4 to the exit 5. The shape of the channels in the nozzle assures gradual conversion of a round jet entering the nozzle into the slot type flow exiting the nozzle via the opening 5. The most important stage of the jet formation occurs at the vicinity of and within the slot. The opening might contain the converging, straight and diverging regions. The geometry of these regions is selected so that the head losses in the course of the jet formation are minimal. The geometry of the channel containing the fluid including the geometry of the exit cross section is determined by the shapes of plates 1 and 2 and the insertion 3. According to the present invention the width of the opening can be controlled by the geometries of the plates 1 and 2 or the geometries of the insertion 3 which separates plates 1 and 2. The cut off of the insertion 3 determines the width of the slot 5, while the thickness of the insertion determines the width of the slot and thus the thickness of developed jet. Because the external forces 6 applied to plates deform the plates and the insertion, the opening geometry also depend on this forces.

The action of the external forces generated, for example by fasteners connecting the plates, brings about the deformation of the plates and the insertion. This deformation determines the shape of the opening 5 as well as the sealing of the nozzle. The magnitude of the forces 6 and the topography of the adjoining surfaces of the plates and the insertion assure complete sealing of the nozzle body. Thus the leaks of the fluid from the nozzle are prevented and all supplied fluid exits via the opening in the nozzle. The sealing of the nozzle can be enhanced still further by soldering or brazing the interfaces between plates and between plates and insertion. The interface can also be filled by special grease, glue etc.

The insertion can comprise layers fabricated of various plastic, brittle and elastic materials. The properties of the layers can be selected so that the compression of the insertion by the fasteners results in the formation of an effective seal. The insertion can be readily fabricated and replaced.

The nozzle can be formed without the insertion. In this case the plates 1 and 2 are attached by the polished surfaces and the sealing of the nozzle is assured by the hydraulic resistance of plates' interface.

Figure 2:
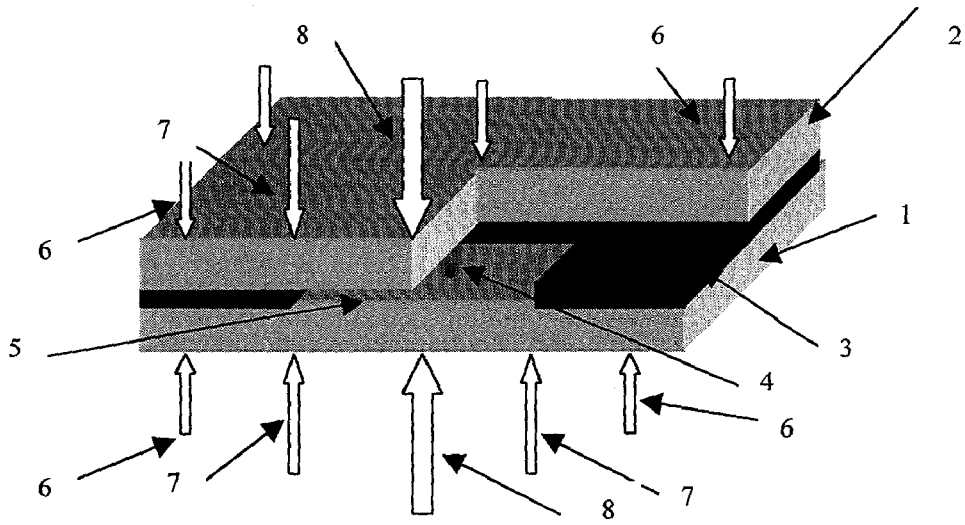
FIG. 2 is a schematic of the slot nozzle with the variable external forces distributed across the nozzle.

The distribution of the external forces 6,7 and 8 can be changed in order to control the shape of the opening 5, that is the shape of the jet and the flow rate of the fluid (FIG. 2). This distribution can be changed automatically in the course of the use of the jet. Thus on-line process control is possible.

Figure 3:
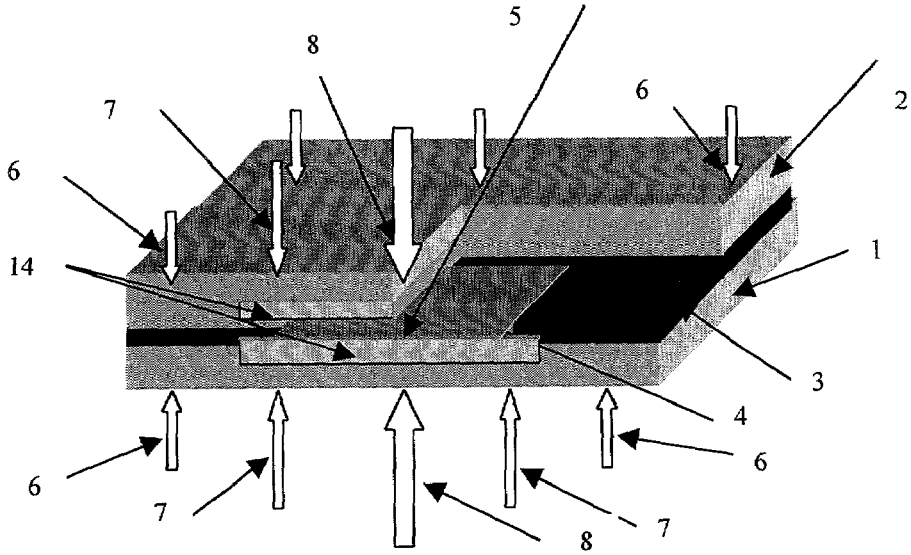
FIG. 3. is a schematic of the slot nozzle with replaceable high wear resistance member

The formation of the high speed jets results in a rapid wear of the surfaces of the slot exit. In order to restore the shape of the opening the nozzle should be disassembled and the surfaces should be machined and polished. Soldering or brazing the plates does not impede their disassembly. Conventionally, the orifices of the high pressure nozzles constitute a readily replaceable member fabricated out of high wear resistant materials. The similar approach can be applied to the invented nozzle The opening can be formed by the replaceable wear resistant members 14 (FIG. 3) closely attached to the plates 1 and 2 by the pressure exerted by the fluid flowing through the nozzle and the external forces 6. The member 14 as well as the insertion 3 can be readily removed and restored by machining or replaced. The simplicity and the low cost of the restoration of the nozzle geometry enable us to use the invented nozzle for acceleration of highly erosive media, for example abrasive slurry.

Figure 4:
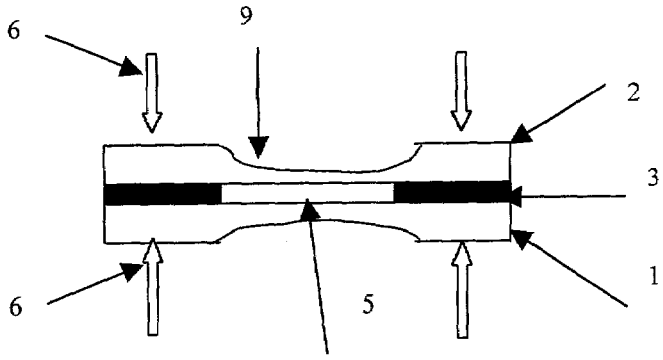
FIG. 4 is a schematic of the nozzle cross section showing the control of the elastic properties of the plates by the variation of the plates' geometry.

The shape of the slot can be controlled by the variation of plate geometry. Variation of the plate thickness results in different deformation 9 across the plate (FIG. 4) and thus in variation of the slot geometry . This enables us to control the shape of the jet. For example the jets having ellipsoidal or sinusoidal cross sections can be formed.

Figure 5:
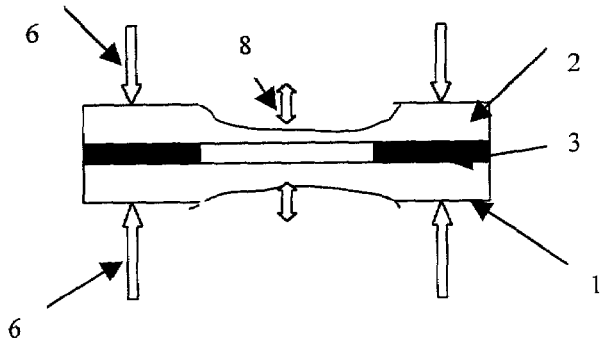
FIG. 5. is a schematic of the slot nozzle showing the vibration of plates due to the action of the external forces and the plates' elasticity.

The external forces 8 (FIG. 5) can be periodically applied to the elastic plates so that the applied forces and the resulting elastic reaction of the plates bring about generation of the resonance vibration of the plates and corresponding compression of the fluid in the nozzle. The pulse jet of the desired frequency will be generated with no additional compressing facilities.

Figure 6:
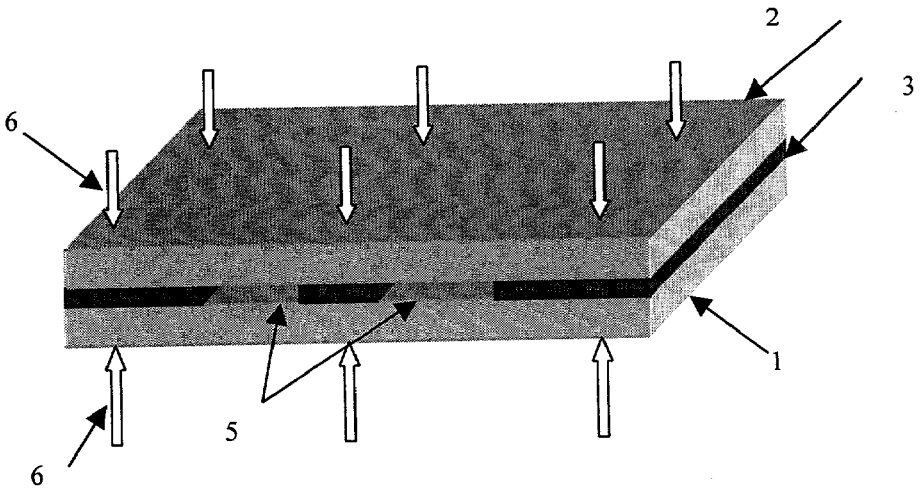
FIG. 6 is a schematic of the cross section of the slot nozzle showing the formation of a plurality of jets of the controlled direction.
Figure 7:
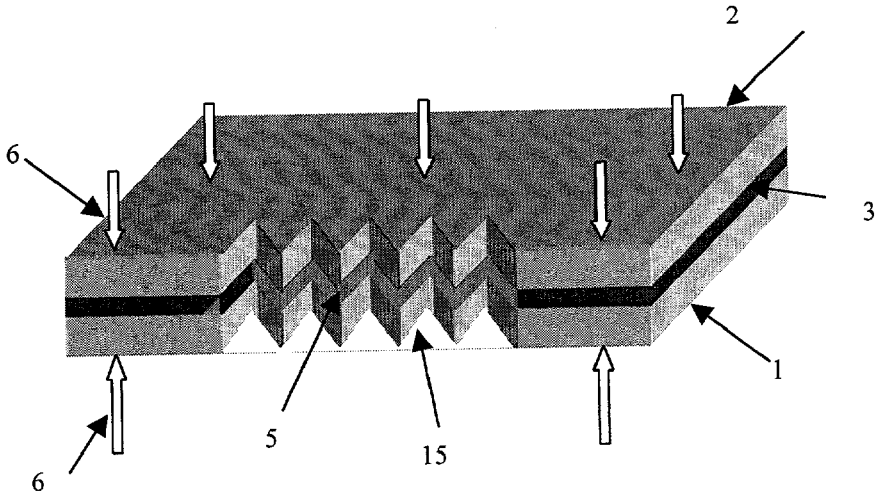
FIG. 7 .is a schematic of the slot nozzle showing the formation of the jet is having the controllable velocity distribution at the jet cross-section.

The slot can be shaped so that a plurality of jets of different width 5 will be formed (FIG. 6) .or jet will be decomposed in the array of droplets. The geometry of the plates and the insertion 14 enables to control the distribution of the magnitude and direction of the jet velocity 15 across the jet (FIG. 7).

Figure 8:
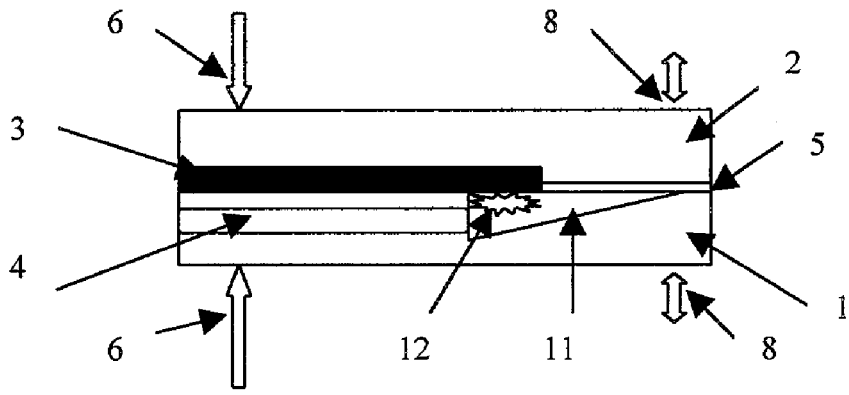
FIG. 8 is a schematic of the cross section of the slot nozzle showing the excitation force generated by the direct energy injection into the fluid contained in the reservoir.
Figure 9:
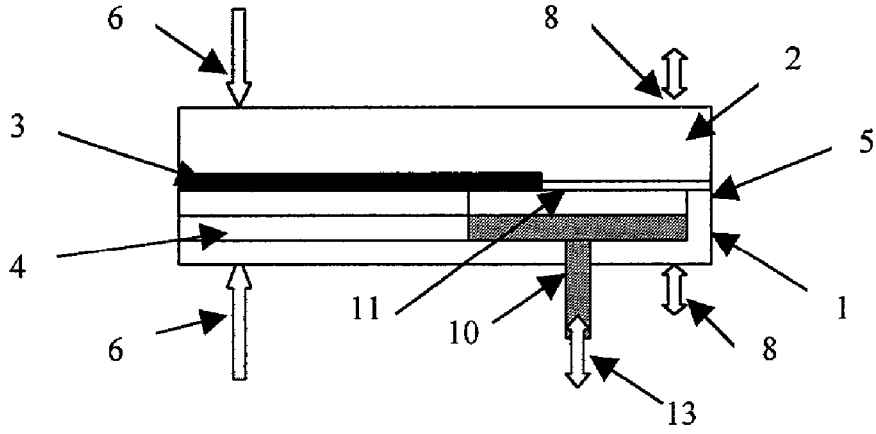
FIG. 9 is a schematic of the cross section of the slot nozzle showing the excitation force generated by the mechanical impact.

The energy needed for the additional compression of the fluid can be injected directly into the reservoir via the electrical discharge, induction heating of the fluid, powder explosion 12 (FIG. 8) or mechanical impact 13 via the piston 10 (FIG. 9).

A very wide slot can be formed by several attached plates connected by the keys The fabrication of such plates is much less expensive than fabrication of wide plates. The use of the sectioned plates enables us to generate very wide jets.

The high aspect ratio of the generated jet enables us to use it for formation of a homogeneous mixture of the several fluids or fluids and particle. The mixture in this case can be formed by the optimal distribution of supplied fluids or particles across the fluid stream. This technique can be used to add polymers into the jet or formation of the suspension jet. The mixture of the several fluids and particle can be formed after the exit of the jet from the nozzle. In this case the jet is supplied into chamber and additional component is entrained into the jet due to the vacuum created in this chamber. A sequence of the chambers can be used to create a mixture of the several fluids and particulates.

The proposed method of the jet formation can be used for material production, including the fabrication of non-conventional non-equilibrium materials. A fluid, for example water, or mixture of fluid can be compressed to a desired pressure and preheated to a desired temperature in a chamber prior to the entering the slot. In the course of the fluid acceleration in the slot pressure dramatically drops. At the same time high speed, high degree of the turbulence and low thickness of the fluid stream assure the feasibility to rapidly change temperature and the composition of the stream and to induce desired electrical and magnetically fields within the stream. The rapid change of the fluid and attainment the extreme fluid properties enable us to develop conditions which can bring about desired material modification and formation of new materials.

What is claimed is:

1. A method of jet formation, comprising the steps of providing two plates which form therebetween a cavity for receiving a fluid and a slot for expelling the fluid as a jet; and applying a force to said plates so that at least one of said plates is deformed to seal said plates relative to one another and also to determine a shape of said slot.

2. A method as defined in claim 1; and further comprising controlling a hydraulic resistance between said plates by a distribution of said force applied to said plates.

3. A method as defined in claim 1; and further comprising controlling said force on-line manually or automatically in order to optimize properties of the jet.

4. A method as defined in claim 1; and further comprising selecting elastic properties of said plates from conditions of optimization of characteristics of the jet.

5. A method as defined in claim 1; and further comprising forming the jet as a pulsed jet by vibrating at least one of said plates under the action of the force and a reaction force due to elasticity of said at least one plate.

6. A method as defined in claim 5; and further comprising vibrating said at least one plate in a resonance mode so that the fluid is compressed sufficiently for forming the jet.

7. A method as defined in claim 1; and further comprising generating an excitation force by a direct energy injection into the fluid contained in said chamber.

8. A method as defined in claim 7; and further comprising providing the direct energy injection into the fluid via an electrical discharge.

9. A method as defined in claim 7; and further comprising providing the direct energy injection into the fluid via squeezing of said plates by an action selected from the group consisting of a magnetic force and transducers.

10. A method as defined in claim 7; and further comprising providing direct energy injection by squeezing said plates under the action of a mechanical impact.

11. A method as defined in claim 1; and further comprising an elastic insertion separating said plates; and determining a geometry of the jet by a pressure exerted by said plates on said elastic insertion.

12. A method as defined in claim 1; and further comprising arranging an insertion between said plates; and determining a geometry of the let by a replaceable member which has high wear resistance and is located between said plates and said insertion.

13. A method as defined in claim 1; and further comprising forming the slot with a geometry which determines a formation of a plurality of the jets in a controlled direction.

14. A method as defined in claim 1; and further comprising determining a hydraulic resistance of a nozzle formed by said plates, by roughness of a contact area of said plates.

15. A method as defined in claim 1; and further comprising farming the jet by a compressed mixture of several fluids and particulate supplied into said cavity prior to said slot.

16. A method as defined in claim 1; and further comprising controlling a hydraulic resistance of a contact zone between said plates by soldering of said plates and an insertion located between said, plates in a compressed state.

17. A method as defined in claim 1; and further comprising controlling a hydraulic resistance of a nozzle formed by said plates by a material selected from the group consisting of a glue and a grease separating said plates.

18. A method as defined in claim 1; and further comprising controlling a width of the jet by attachment of several of said plates connected with one another by keys.

19. A method as defined in claim 1; and further comprising developing an attraction between a nozzle formed by said plates and a workpiece by a vacuum developed in a rectangular slot formed between a front plane of the nozzle and a plane of the workpiece.

20. A method as defined in claim 1; and further comprising rapidly changing a pressure and a temperature of the fluid within said slot, so that a rate of change and fluid properties ensure a desired material conversion.

21. A nozzle for forming a jet, comprising two plates forming therebetween a cavity for receiving a fluid and a slot for expelling the fluid; and means for applying a force to said plates such that at least one of said plates is deformed and seals said plates relative to one another and also determines a shape of said slot.

22. A nozzle as defined in claim 21; and further comprising a deformable insertion located between said plates and forming said slot.

23. A nozzle as defined in claim 21, wherein said insertion between said plates includes elastic, brittle, and plastic layers.

24. A nozzle as defined in claim 21, wherein said plates include a sequence of plates which are connected by keys and form said slot.

25. A nozzle as defined in claim 21, wherein said slot has a geometry selected from conditions of optimization of properties of the jet.

26. A nozzle as defined in claim 21, wherein said chamber includes a plurality of subchambers each connected with a source of a fluid or particles.

27. A nozzle as defined in claim 21; and further comprising a porous plug inserted in said plates for forming said slot.

* * * * *